United States Patent [19]

Corley

[11] 3,998,011

[45] Dec. 21, 1976

[54] HONING TOOL

[75] Inventor: William G. Corley, Dearborn Heights, Mich.

[73] Assignee: Ex-Cell-O Corporation, Troy, Mich.

[22] Filed: Oct. 6, 1975

[21] Appl. No.: 619,742

[52] U.S. Cl. ..... 51/338; 51/204; 51/345

[51] Int. Cl.[2] ..... B24B 33/02; B24B 33/08

[58] Field of Search ..... 51/338–346, 51/204

[56] References Cited

UNITED STATES PATENTS

| | | | |
|---|---|---|---|
| 2,268,479 | 12/1941 | Gjertsen | 51/339 |
| 2,419,067 | 4/1947 | Gazolas | 51/342 |
| 2,443,268 | 6/1948 | Palotsee | 51/344 |
| 2,729,924 | 1/1956 | Klein | 51/344 X |
| 3,871,140 | 3/1975 | Kramm et al. | 51/204 X |

*Primary Examiner*—Al Lawrence Smith
*Assistant Examiner*—K. J. Ramsey
*Attorney, Agent, or Firm*—James H. Bower; Mitchell J. Hill

[57] ABSTRACT

A honing tool having an elongated tubular body adapted to be supported for rotational movement about a longitudinal axis in a bore of a workpiece, and adapted for reciprocation in said bore. A transverse slot is formed in said body for the reception of a pair of diametrically disposed honing stones, and wherein the outer face is convexly formed. A spring biased retainer means is mounted in said body for individually retaining each of said honing stones longitudinally in said body. An expansion wedge-like cam means is operatively mounted in said body for pushing the honing stones outwardly into an operative honing engagement with the surface of a bore in a workpiece. Each of the honing stones includes an elongated, inverted T-shaped holder having a raised central front portion and which is formed with a rear flat face in which is formed at least one rectangularly shaped recess that communicates with an inclined expansion angle or inclined surface. The expansion angle is adapted to be engaged by the expansion wedge-like cam means. The abrasive material is U-shaped in cross section and is bonded to the raised central front portion of the holder.

6 Claims, 8 Drawing Figures

HONING TOOL

SUMMARY OF THE INVENTION

This invention relates to the honing tool art and more particularly, to a novel and improved honing tool incorporating a pair of novel and improved honing stones.

Honing tools have been provided heretofore for enlarging bores in a workpiece and for providing a desired finish to the surface of a bore. The prior art honing tools have disadvantages in that some of them require a large number of abrasive assemblies or honing stones, and each of the abrasive assemblies includes spring inserts and a plastic, aluminum or magnesium shell arrangement. Such prior art honing tools also require various types of guide members on the hone body. Other disadvantages of the prior art honing tools is that they have an initial high cost, they are inefficient in operation, and they employ honing stones wherein the abrasive is mounted in a plastic holder and both the abrasive and plastic are in contact with the work surface, whereby the abrasive area that can be brought into contact with the work surface is limited. The construction of the prior art honing stones is also such that the volume of abrasive available in a honing stone is limited.

In view of the foregoing, it is an important object of the present invention to provide a novel and improved honing tool which incorporates a novel honing stone construction that overcomes the aforementioned disadvantages of the prior art honing tools and honing stone constructions.

It is another object of the present invention to provide a novel and improved honing tool which is simple in construction, economical and feasible to manufacture, and which is efficient, economical and reliable in operation.

It is still another object of the present invention to provide a novel and improved honing tool which includes a reduced number of abrasives or honing stones as compared to the prior art honing tools wherein a large number of honing stones were required.

It is still another object of the present invention to provide a novel and improved honing tool which includes at least two honing stones that are of a simple and compact construction, and which have a greater abrasive surface contact area and a greater abrasive volume than the prior art honing stones.

It is a still further object of the present invention to provide a novel and improved honing tool which includes an elongated, tubular body adapted to be supported for rotational movement about a longitudinal axis in a bore in a workpiece, and adapted for reciprocation in said bore. A transverse slot is formed in said body for the reception of a pair of honing stones. Retainer means is mounted in said body for retaining individually each of said stones longitudinally in said body. An expansion means is mounted in said body for pushing said stones transversely outward into honing engagement with the surface of the bore. The honing stones each include an inverted T-shaped holder to which is bonded an abrasive material that is U-shaped in cross section.

Other objects, features and advantages of this invention will be apparent from the following detailed description, appended claims, and the accompanying drawings.

DESCRIPTION OF THE PREFERRED EMBODIMENTS

Figure 1:
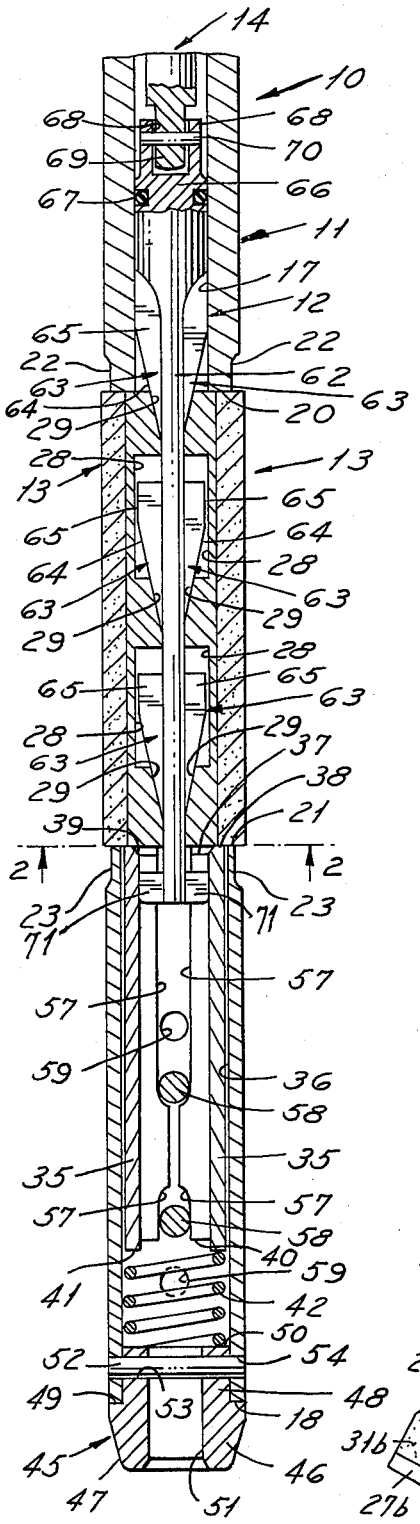
FIG. 1 is a longitudinal section view of an illustrative embodiment of the honing tool of the present invention.

Referring now to the drawings, and in particular to FIG. 1, the numeral 10 generally designates a honing tool made in accordance with the principles of the present invention. The honing tool 10 includes an elongated cylindrical body, generally indicated by the numeral 11, in which is slidably mounted an expansion means or a rod having wedge-like cam means, generally indicated by the numeral 12. The expansion means 12 is adapted to expand a pair of abrasive assemblies of honing stones, which are each generally indicated by the numeral 13. The expansion means 12 is adapted to be moved axially in the honing tool body 11 by a conventional actuator rod, generally indicated by the numeral 14. The body 11 is adapted to be connected to a suitable drive shaft for providing rotation and reciprocation of the honing tool 10 about its longitudinal axis.

Figure 2:
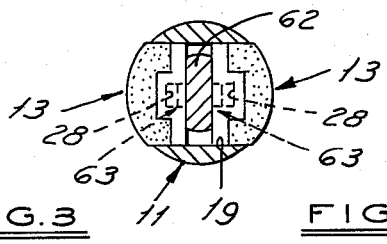
FIG. 2 is a transverse section view of the honing tool structure illustrated in FIG. 1, taken along the line 2—2 thereof, and looking in the direction of the arrows.

As shown in FIG. 1, the honing tool body 11 is provided with a longitudinal bore 17 in which is slidably mounted the expansion means or expansion cone 12. The upper end of the body 11 is shown as being broken off, but it will be understood that said upper end of the body 11 may be connected by any suitable means to a conventional drive means for reciprocation and rotation of the honing tool 10. The lower end of the body 11 is indicated by the numeral 18. As best seen in FIG. 2, the honing body 11 is provided with an elongated, transverse slot 19 in which is seated by a press fit the pair of diametrically and oppositely disposed honing stones 13. The upper end of the slot 19 is indicated in FIG. 1 by the numeral 20, and the lower end of the slot 19 is indicated by the numeral 21. As shown in FIG. 1, the honing body 11 is provided with a pair of oppositely disposed recesses 22 on the outer periphery thereof which communicate with the slot 19 at the upper end of said slot. A second pair of said peripheral recesses 23 are formed at the lower end of the slot 19. The recesses or relieved areas 22 and 23 provide finger grip areas to permit engagement with the ends of the honing stones 13, for insertion and removal of the same from the body 11.

Figure 3:
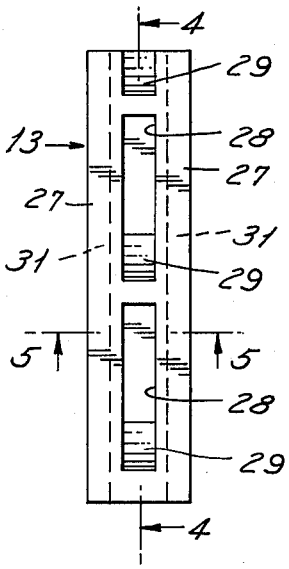
FIG. 3 is a rear plan view of a first honing stone embodiment made in accordance with the principles of the present invention, and which is employed in the honing tool structure illustrated in FIG. 1.
Figure 4:
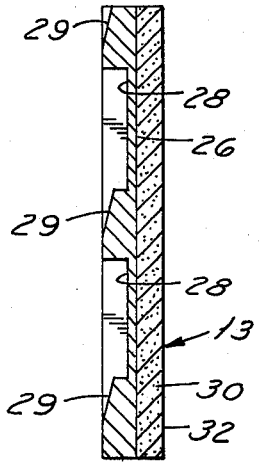
FIG. 4 is a longitudinal section view of the first honing stone embodiment illustrated in FIG. 3, taken along the line 4—4 thereof, and looking in the direction of the arrows.
Figure 5:
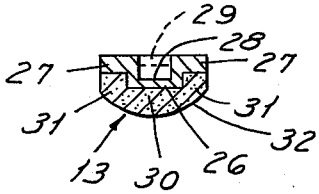
FIG. 5 is a transverse section view of the first honing stone embodiment illustrated in FIG. 3, taken along the line 5—5 thereof, and looking in the direction of the arrows.

The details of the construction of each of the abrasive assemblies or honing stones 13 are shown in FIGS. 3, 4 and 5. As best seen in FIG. 5, each of the honing stones 13 includes a holder body that comprises a centrally disposed and longitudinally extended raised portion, designated by the numeral 26, which is rectangular in cross section. Integrally attached to the inner end or rear end of the central portion 26 of the holder body are a pair of outwardly extended flanges 27, which are disposed transversely of the honing stone construction. The rear faces of the flanges 27 and the rear face of the central portion 26 provides a flat rear holder face.

As best seen in FIGS. 3 and 4, a pair of centrally disposed and longitudinally spaced apart recesses 28 are formed in the holder body central portion 26, and they extend inwardly from the rear face of the holder. The recesses 28 are rectangular in transverse and longitudinal shape, and they communicate at one end thereof with a recess which has an inclined lower surface indicated by the numeral 29. A third recess of the last mentioned type is also formed on one end of each of the honing stones 13, as shown in FIGS. 3 and 4, and it also has an inclined surface 29. As shown in FIG. 4, the three inclined surfaces 29 are all disposed in the same direction, and they are equally spaced longitudinally of the honing stone 13 to provide a plurality of expansion angled surfaces for engagement with the wedge-like cam members on the expansion means 12, as more fully described hereinafter.

As best seen in FIG. 5, each of the honing stones 13 is provided with a suitable abrasive material on the outer face thereof, which is U-shaped in cross section and includes a central, longitudinally extended body portion that is integral with a pair of side portions 31. The outer sides of the abrasive portions 31 are parallel with the outer sides of the holder flanges 27 and perpendicular to the rear face of the rear holder. The abrasive material portions 30 and 31 are anchored to the holder portions 26 and 27 by any suitable means, as by being bonded thereto by a conventional bonding process. The holder, comprising the portions 26 and 27, may be made from any suitable material, as for example, from an aluminum die cast material or plastic material. The numeral 32 in FIG. 5 designates the outer convex face of the abrasive portion of the honing stone 13. The convex outer surface 32 terminates at the parallel outer sides of the leg portions 31 of the abrasive material. The surface 32 is a portion of a circle.

The pair of abrasive assemblies or honing stones 13 are press fitted into the slot 19, in opposing positions, and they are held in place longitudinally by a spring biased pressure means that engages the lower ends thereof. The spring biased pressure means for retaining the honing stones 13 in axial position in the body 11 includes a pair of semi-circular split bushings 35 which are slidably mounted in the lower end of the bore 17, which bore lower end is formed to an enlarged diameter and indicated by the numeral 36. The upper end of each of the split bushings 35 is slotted, as indicated by the numeral 37, so as to provide a shoulder 38 for engagement with the lower end of the adjacent honing stone 13. An integral, cylindrical bushing could be employed for engaging the lower ends of the honing stones 13, but it is preferable that a pair of split bushings 35 be used, because the split bushings 35 provide an individual retaining pressure against each of the honing stones 13. The provision of an individual pressure against each of the honing stones 13 compensates for any difference in lengths between the honing stones 13. A chamfer 39 is provided on the inner side of each of the bushing shoulders 38 for ease of assembly of the expansion means 12 into the split bushings 35. The lower ends of each of the split bushings 35 are also provided with a transverse slot 40 to provide a shoulder 41 on each of the split bushings 35 for seating engagement with the upper or inner end of a suitable coil spring 42.

As shown in FIG. 1, the spring 42 has its lower or outer end operatively seated on the inner end of a suitable nose plug, generally indicated by the numeral 45. The nose plug 45 includes a body 46 that has a conical outer surface 47 on its outer end. A cylindrical shaft 48 is integrally formed on the inner end of the nose plug body 46, and it is slidably mounted within the body bore 36. The junction point between the shaft 48 and the plug body 46 provides a shoulder 49 on which is seated the lower end 18 of the body 11. The rear end 50 of the shaft 46 provides a seat for the lower end of the spring 42. An axial bore 51 is formed through the nose plug 45, and it communicates with the interior of the lower end of the body bore 36, for drainage purposes. The nose plug 45 is retained in the lower end of the body 11 by a suitable cross pin 52 which is operatively mounted through a transverse bore 53 formed through the plug shaft 48, and suitable bores 54 formed through the wall of the body 11.

The opposed longitudinal edges of the split bushings 35 are provided with a pair of longitudinally spaced apart relieved portions 57 to provide a pair of opposed slots for the reception of a pair of fixed guide pins 58. The guide pins 58 are transversely disposed in the body 11 and have their outer ends fixedly mounted in suitable bores in the body 11, as by a press fit. A pair of drain holes 59 are provided in the lower end of the body 11 for passage therethrough of coolant fluid, and for flushing purposes. It will be seen that the spring 42 maintains a constant upward pressure on the split bushings 35 which in turn provide an individual pressure against each of the honing stones 13 to maintain them longitudinally in the slot 19.

As shown in FIG. 1, the expansion means 12 includes an elongated rod 62, which is substantially rectangular in cross section, as shown in FIG. 2. When the honing stones 13 are disposed in their innermost positions, the inner flat faces of the holder portions are seated against the parallel and longer faces of the rod 62, as shown in FIGS. 1 and 2. As shown in FIG. 1, the expansion means 12 includes three pairs of oppositely disposed wedge-like cam members, each generally designated by the numeral 63, and which are integrally formed with the rod 62. The wedge-like cam members 63 are blade shaped so as to fit into the recesses 28 and 29 which are formed in the rear faces of the honing stones 13.

Each of the wedge-like cam members 63 is provided at its forward end, or lower end as viewed in FIG. 1, with an angled or tapered edge which may be termed a cam surface angle 64. The cam surface angle 64 is integral at its rear end with a wedge-like cam member body 65 which is adapted to mate with and be seated in one of the recesses 28 in an adjacent honing stone 13. Each of the cam surface angles 64 is adapted to operatively engage an adjacently disposed inclined recess surface 29 on an adjacent honing stone 13.

The upper end of the rod 62 is integrally secured to a cylindrical head 66 which has a reduced diameter upper end in which is formed a countersunk or recessed hole 68. A reduced diameter end 69 on the acuator rod 14 is mounted in the recessed hole 68, and it is swingably connected to the head 66 by a suitable cross pin 70 that has its ends pressfitted in a suitable bore formed through the head 66. A suitable O-ring sealing means 67 is operatively mounted in a groove around the head 66 to prevent coolant from flowing back into the expansion mechanism that operates the actuator rod 14. As shown in FIG. 1, a pair of oppositely disposed pilot members 71 are integrally formed on the lower end of the rod 62. The pilot members 71 are slidably mounted within the upper ends of the split bushing 35.

In use, each of the abrasive honing stones 13 is mounted in the slot 18 by positioning one end thereof against the respective shoulder 38, and then pressing downwardly and fitting the other end into the position shown in FIG. 1. The honing stones 13 are shown in FIG. 1 as being in the fully retracted position, as when the honing stones 13 are new. The honing tool 10 is then used in the normal manner for a honing operation wherein the honing tool 10 is simultaneously reciprocated and rotated. The two honing stones 13 do not leave the bore in a workpiece during a honing operation, and accordingly, no guide members are required on the body 11. The actuator rod 14 functions to move the expansion means 12 downwardly, as shown in FIG. 1, so that the cam surface angles 64 on the wedge-like cam members 63 engage the inclined recess surfaces 29 for pushing the honing stones 13 radially outward. The wedge-like cam member body 65 of each of the wedge-like cam members 63 is seated in a recess 28, as shown in FIG. 1. When the abrasive material 30 and 31 wears down to a point where the holder central portion 26 is exposed, the worn honing stones 13 may be quickly and easily removed by merely grasping the same and exerting a radial outward pressure thereon. New honing stones 13 may then be quickly and easily inserted into the holder body 11, as described hereinbefore.

Figure 6:
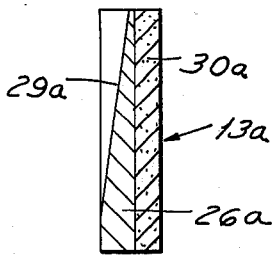
FIG. 6 is a longitudinal section view, similar to FIG. 4, of a second honing stone embodiment employed in the present invention

FIG. 6 shows a second honing stone embodiment wherein the honing stone is generally designated by the numeral 13*a*. The parts of the honing stone 13*a* which are the same as the parts in the honing stone 13 have been marked with the same reference numerals followed by the small letter *a*. The honing stone 13*a* represents an embodiment wherein only one inclined recess surface 29*a* is employed. A single inclined surface 29*a* may be employed with short length honing stones. It will be understood that the expansion means 12 employed for use with the honing stone 13*a* would employ a single pair of wedge-like cam members 63 when two of the honing stones 13*a* are employed.

Figure 7:
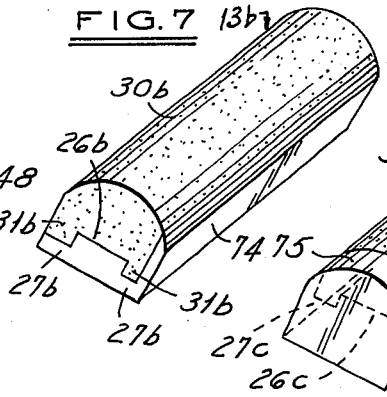
FIG. 7 is a perspective view of a third honing stone embodiment employed in the present invention.

FIG. 7 shows a third honing stone embodiment wherein the honing stone is generally designated by the numeral 13*b*. The parts of the honing stone 13*b* which are the same as parts in the honing stone 13 have been marked with the same numerals followed by the small letter *b*. The honing stone 13*b* represents an embodiment wherein the honing stone is provided along one longitudinal side thereof with a side guide member 74. The side guide member 74 is perpendicular to and integrally formed with the inverted T-shaped holder portion. The side guide member 74 is substantially plate-shaped in configuration, and the upper longitudinal edge thereof is convexly shaped as a continuation of the convex surface of the honing stone portion 30*b*. It will be understood that the guide member 74 will wear down evenly during the wearing down action on the stone portion 30*b*. The abrasive material on the honing stone 13*b* extends substantially over the entire outer face of the stone.

Figure 8:
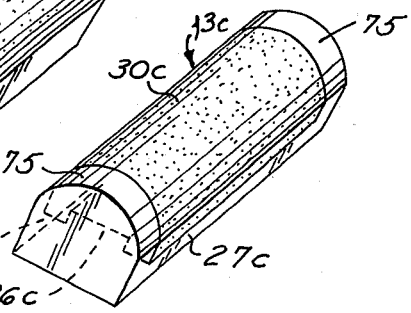
FIG. 8 is a perspective view of a fourth honing stone embodiment employed in the present invention.

FIG. 8 shows a fourth honing stone embodiment wherein the honing stone is generally designated by the numeral 13*c*. The parts of the honing stone 13*c* which are the same as parts in the honing stone 13 have been marked with the same reference numerals followed by the small letter *c*. The honing stone 13*c* represents an embodiment wherein the honing stone is provided on each end thereof with a transverse tab 75 which functions as a guide member and for use in operating a conventional automatic sizing apparatus. The tabs 75 are substantially plate-shaped in configuration, and the upper transverse edges thereof are convexly shaped as a continuation of the convex surface of the honing stone portion 30*c*. The tabs 75 are perpendicular to and integrally formed with the inverted T-shaped holder portion. The abrasive material on the honing stone 13*c* extends substantially over the entire outer face of the stone. It will be understood that the tabs 75 will wear down evenly during the wearing down action of the stone portion 30*c*.

It will be understood that the honing stone 13 may be provided with as many inclined recessed surfaces 29 as desired and a mating expansion means 12 with a complimentary number of wedge-like cam members 63.

It will be seen that the honing tool 10 of the present invention provides a honing tool having a reduced number of abrasives or honing stones, as compared to the prior art honing tools wherein a large number of honing stones are used. For example, in many of the prior art honing tools, at least nine abrasive assemblies are used. Furthermore, the honing tool 10 is simpler in construction that the prior art honing tools since there is no need for any spring inserts, magnesium shell arrangements, and carbide guides on the outer diameter of the hone body as are required in the prior art honing tools. It has been found that the honing tool 10 of the present invention is also less costly than prior art honing tools for accomplishing an equivalent honing operation, and that a honing operation can be carried out faster and more parts can be honed with one set of stones than can be accomplished with the prior art honing tools. The honing tool 10 of the present invention is also more economical than the prior art honing tools in that downtime is materially reduced for changing the honing stones 13, and the amount of set-up time and repair-time is also reduced. The honing tool 10 of the present invention is more efficient in operation than the prior art honing stones, and hones a better part, well within the print requirements.

The novel construction of the honing stones 13 provides a honing stone which has a greater abrasive surface area for contact with the surface of a bore in a workpiece. The novel construction of the honing stone 13 also provides a honing stone which has a larger volume of abrasive material, whereby the honing stone 13 has a longer working life than the prior art honing stones. The novel construction of the holder portion of the honing stone 13, with is hollowed-out design, permits the use of what is normally a lost area in the construction of a honing stone, and wherein said lost area is used for additional abrasive expansion so as to provide the aforementioned increased abrasive volume.

The increased abrasive area is provided by the broader contact face or increased area of the convex surface 32 of the honing stone 13, which surface extends over the entire outer face of the honing stone in the first illustrated embodiment. The inverted T-shaped stone holder allows for the use of the U-shaped abrasive portion of the stone.

While it will be apparent that the preferred embodiments of the invention herein disclosed are well calculated to fulfill the objects above stated, it will be appreciated that the invention is susceptible to modification, variation and change.

What is claimed is:

1. A honing stone for use in a honing tool having expansion means provided with plurality of wedge-like cam member bodies and a cam surface angle thereon, comprising;

A. a holder body (13) said holder body being an inverted T-shaped in cross section comprising;
   1. a centrally disposed and longitudinally extended raised portion (26) rectangular in cross section;
   2. a pair of outwardly extended flanges (27) integrally connected to the rear end of said central portion (26);
   3. the rear faces of said flanges (27) and the rear face of said central portion (26) provides a parallel flat rear holder face for said holder body (13);
   4. a pair of centrally disposed and longitudinally spaced apart recesses (28) formed in said holder body central portion (26) extending inwardly from said rear face of said holder, each of said recesses;
      a. rectangular in transverse and longitudinal shape; and
      b. communicating at one end thereof with a recess which has an inclined lower surface (29);
   5. each of said inclined surfaces (29) disposed in the same direction and equally spaced longitudinally of said honing body (13) to provide a plurality of expansion angled surfaces for engagement with each of said wedge-like cam members (63); and B. An abrasive bonded to said holder body, said abrasive:
   1. being U-shaped in cross-section;
   2. a central, longitudinally extended body portion that is integral with a pair of side portions (31);
   3. said outer sides of said abrasive are parallel with outer sides of said rear holder flanges (27) and perpendicular to said rear face of said holder; and
   4. the outer surface of said abrasive being convex (32).

2. A honing stone as defined in claim 1 comprising a third recess formed on one end of said honing body having an inclined surface.

3. A honing tool as defined in claim 1, wherein:
a. each of said honing stones is provided with a longitudinally extended guide member along one side thereof.

4. A honing tool as defined in claim 1, wherein:
a. each of said honing stones is provided with a transverse guide tab on each end thereof.

5. A honing tool, comprising:
a. an elongated body adapted to be supported for rotational movement about a longitudinal axis in a bore of a workpiece and for reciprocation in said bore;
b. said body having at least one transverse slot;
c. plug means retained in the lower end of said body;
d. at least one honing stone mounted in said transverse slot;
e. retainer means mounted in said body for retaining said honing stone longitudinally in said body, said retaining means, comprising:
   1. a pair of semi-circular split bushings which are slidably mounted in the lower end of the bore of said body;
   2. the upper end of each of said slit bushings being slotted, so as to provide a shoulder for engagement with the lower end of the adjacent honing stone; and
   3. spring means mounted between the lower ends of said split bushings and said plug means.

6. A honing tool as defined in claim 5, wherein said plug means comprises an axial bore which communicates with the interior of the lower end of said body for drainage purposes.

* * * * *